US007223210B2

(12) United States Patent
Krul et al.

(10) Patent No.: US 7,223,210 B2
(45) Date of Patent: May 29, 2007

(54) QUAD CYCLE AND EXERCISE MACHINE

(76) Inventors: Steve R. Krul, 1501 W. 45th Pl., Kennewick, WA (US) 99336; Walter Krul, 1501 W. 45th Pl., Kennewick, WA (US) 99336

( * ) Notice: Subject to any disclaimer, the term of this patent is extended or adjusted under 35 U.S.C. 154(b) by 489 days.

(21) Appl. No.: 10/688,488

(22) Filed: Oct. 17, 2003

(65) Prior Publication Data

US 2005/0085347 A1 Apr. 21, 2005

(51) Int. Cl.
*A63B 22/06* (2006.01)
*B62M 1/00* (2006.01)

(52) U.S. Cl. ..... 482/57; 280/224; 280/234

(58) Field of Classification Search ..... 482/57, 482/62; 280/221, 224, 225, 233, 234, 240, 280/282

See application file for complete search history.

(56) References Cited

U.S. PATENT DOCUMENTS

| | | | | |
|---|---|---|---|---|
| 891,872 | A * | 6/1908 | Smith | 280/238 |
| 1,479,887 | A * | 1/1924 | Bitner | 280/234 |
| 1,500,854 | A * | 7/1924 | Starr | 280/241 |
| 3,498,634 | A * | 3/1970 | Sheldon | 280/212 |
| 5,492,349 | A * | 2/1996 | Ferez | 280/248 |
| 5,713,590 | A * | 2/1998 | Clark | 280/247 |
| 5,775,708 | A * | 7/1998 | Heath | 280/234 |
| 6,032,970 | A | 3/2000 | Porter | 280/234 |
| 6,190,289 | B1 | 2/2001 | Pyles et al. | 482/52 |
| 6,378,882 | B1 | 4/2002 | Devine | 280/234 |
| 6,485,041 | B1 | 11/2002 | Janssen | 280/221 |

* cited by examiner

*Primary Examiner*—(Jackie) Tan-Uyen Ho
*Assistant Examiner*—Tam Nguyen
(74) *Attorney, Agent, or Firm*—Floyd E. Ivey; Liebler, Ivey, Connor, Berry & St. Hilaire

(57) ABSTRACT

This invention is a quad cycle and exercise apparatus with arm and foot power as propulsion. The rider is upstanding during operation.

1 Claim, 8 Drawing Sheets

QUAD CYCLE AND EXERCISE MACHINE

FIELD OF THE INVENTION

This invention relates cycle transportation and exercise equipment and more particularly to a four wheeled arm and foot powered cycle and exercise apparatus.

BACKGROUND OF THE INVENTION

Bicycle and other cycle devices are known in the arts including U.S. patents as follows: U.S. Pat. No. 6,485,041 to Janssen; U.S. Pat. No. 6,378,882 to Devine; U.S. Pat. No. 6,032,970 to Porter; and U.S. Pat. No. 6,190,289 to Pyles et al. The patents referred to herein are provided herewith in an Information Disclosure Statement in accordance with 37 CFR 1.97.

SUMMARY OF THE INVENTION

The quad cycle and exercise machine comprises four wheeled cycle apparatus providing foot pads interrelated to hand operated levers for the operation of a bicycle cam and derailer gear system for propulsion of the quad cycle. The operator is upstanding during operation. Standard bicycle brakes and derailer systems are employed.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
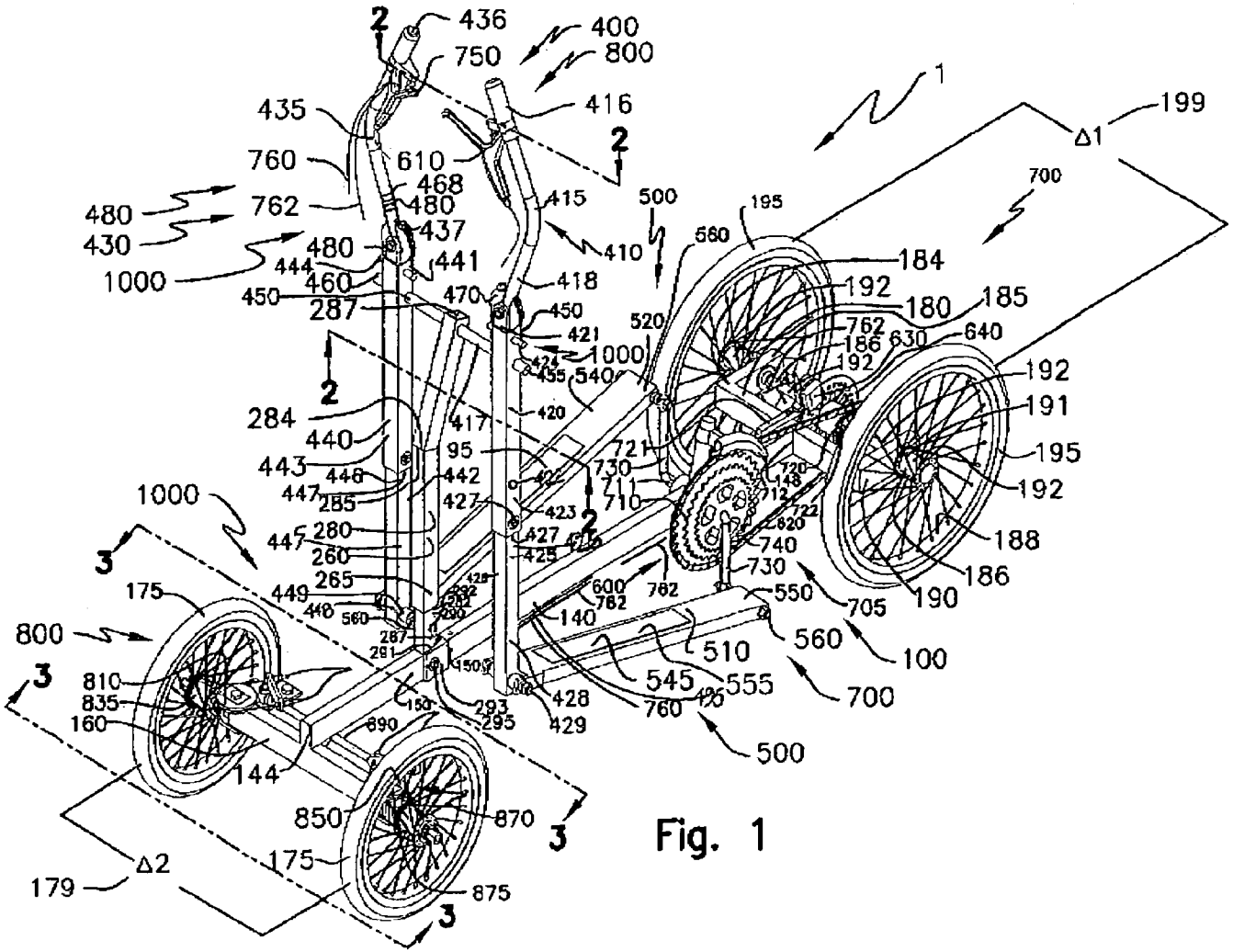
FIG. 1 is a perspective view of the quad cycle (1) showing the main frame (100) with frame center leg (140) and front "T" frame (160) and rear "T" frame (180). Seen is the standard bicycle derailer system (700) and standard bicycle brake assembly (600). The frame center vertical leg (260) is depicted relative to the swing arm assembly (400) which is integral with the means of propulsion and steering; also depicted are the front wheels (175) interrelated with the steering system (800).

FIGS. 1 through 9 depicts the quad cycle (1) and systems composing the quad cycle (1). The quad cycle (1) has a frame means comprising a main frame (100) having at least one elongated center leg (140) having a center leg first end (144) and a center leg second end (148). A front "T" frame (160), generally tubular and elongated, has a front "T" frame first end (164), a front "T" frame second end (168) and is affixed by frame affixing means at the center leg first end (144); the front "T" frame (160) is comprised of a frame member generally orthogonal to the at least one center leg (140). In the preferred embodiment, the front "T" frame (160) has a front "T" frame top (170) and the elongated center leg (140) has a center leg bottom (146); the front "T" frame (160) is affixed at the front "T" frame top (170) proximal the center leg first end (144) at the center leg bottom (146).

A rear "T" frame (180), generally elongated and affixed by frame affixing means at the center leg second end (148); the rear "T" frame (180) is composed of a frame member generally orthogonal to the at least one center leg first end (144). The rear "T" frame (180) has a rear "T" frame right end (184) and a rear "T" frame left end (190). The frame members including those of the main frame (100), in the preferred embodiment, are constructed of a rigid tubular means comprised of metals, composite materials, plastics and other materials commonly recognized by those of ordinary skills in the bicycle arts for frame construction. In the preferred embodiment the main frame, and other frame members, are formed from light weight rectangular metal tubing.

Bearing, axle and wheel means are mounted at the rear "T" frame right end (184) and the rear "T" frame left end (190). Bearing, axle and wheel means are generally so mounted by affixing, by frame affixing means, a bearing mount means at the respective rear "T" frame right end (184) and rear "T" frame left end (190). In the preferred embodiment the rear "T" frame (180) has a right bearing mount (185) affixed by frame affixing means at the rear "T" frame right end (184) positioned generally orthogonal to the rear "T" frame (180) and parallel with the frame center leg (140). The rear "T" frame (180) has a left bearing mount (190) affixed by frame affixing means at the rear "T" frame left end (190) positioned generally orthogonal to the rear "T" frame (180) and parallel with the frame center leg (140). Bearing, bushing and axle means (192) are received by apertures and bearing, bushing and axle receiving means (186) to position the bearings, bushings and axle (192) orthogonal to the frame center leg (140). At least one rear wheel (195) is mounted at said axle (192) and, in the preferred embodiment there are at least two rear wheels (195) mounted at said axle (192), one at the right bearing mount (185) and one at the left bearing mount (190).

A standard bicycle brake system (600) is provided for stopping having brake means (640), including disk brakes; hand grip or lever (610) and brake cable (620) means to communicate braking commands to a caliper means (630) to urge braking forces on the brake means (640).

A standard bicycle derailer (700) assembly is mounted by derailer mounting means (711) at the frame center leg (140) and at the axle (192); a front derailer gear assembly (710) with drive cam (730) is mounted by gear mounting means at the frame center leg (140) intermediate the center leg first end (144) and the center leg second end (148); a front derailer (712) is mounted at a derailer mounting means (711) comprising a bracket support structure capable of receiving a derailer and which is provided in the disclosed invention by an upstanding tube immovably affixed to the frame center leg (140) intermediate the center leg first end (144) and the center leg second end (148). Other equivalent mounting means will be appreciated by those of ordinary skill in the bicycle gear mounting arts. A rear derailer gear assembly (720) is mounted by gear mounting means at the rear axle (192) intermediate the right bearing mount (185) and the left bearing mount (190); rear derailer (722) and rear derailer mounting means (721) is mounted at the rear "T" frame (180). Derailer hand grip or shift levers (750) are in front derailer cable (760) and rear derailer cable (762) communication with the respective front derailer (712) and the rear derailer (722). It will be appreciated that cable means including front derailer cable (760) and rear derailer cable (762), and indeed other cable means disclosed herein, will be routed from controls or source vial frame means members to point of action. A chain drive means (740), provided by endless chain or belt drives or other equivalent gear interconnection means, drive and gear shift interrelates the front derailer gear assembly (710) with the rear derailer gear assembly (722). The brake assembly means (600) and front derailer (712), rear derailer (722), gear and derailer assemblies are affixed by brake assembly and derailer gear and derailer affixing means including bushings, bearings, and other affixing means including races, bolts, screws, washers, rivets, drive cams, seals and other such affixing means as will be appreciated by those of ordinary skill in the bicycle arts.

Steering and propulsion means, driven by arm and foot power, is seen in association with a center vertical frame means (260) seen as the center vertical leg (260), swing arms (400) and foot pads (500). Again, frame means is generally formed from tubular materials including a variety of cross sections and, in the preferred embodiment, a rectangular or square cross section tube of metal or composite materials. The center vertical leg (260) is upstanding and has an upper vertical leg section (280) and a lower vertical leg section (290). The upper vertical leg section (280) has a vertical leg first end (282) and a vertical leg second end (287) with a vertical leg angle (284) intermediate the said vertical leg first end (282) and the vertical leg second end (287). The lower vertical leg section (290) has a lower leg first end (291) and a lower leg second end (292). The lower vertical leg section (290) at the lower vertical section second end (292) is sized to either receive the upper vertical leg section at the vertical leg first end (282) or the vertical leg first end (282) is sized to receive the lower vertical leg section (290) at the lower leg second end (292). Movable or immovable frame affixing means proximal the lower leg second end (292) and the vertical leg first end (282); movable frame affixing means generally aperture means (265) in the upper vertical leg section (280) proximal the vertical leg first end (282) in alignment with aperture means (265)in the lower vertical leg section (290) proximal the lower leg second end (292) where said aligned aperture means (265) receive bolt/nut means (267); immovable frame affixing means includes welding. Those of ordinary skills in the frame arts will appreciate equivalent movable frame affixing means to the use of bolt/nut means (267). Vertical leg bracket means (293) affixed by immovable means at the lower leg first end (291) and oriented to receive the frame center leg (140) intermediate the center leg first end (144) and the derailer mounting means (711).

Said vertical leg bracket means (293) is, in the preferred embodiment tubular or inverse "U" shaped and sized to receive the frame center leg (140); the center vertical leg (260) is moveably or immovably affixed at the frame center leg (140) with movable means generally aperture means in the frame center leg (140) aligned with aperture means in the frame aperture means (150) aligned with aperture means in the leg bracket means (293) and moveably affixed by bolt/nut means (295). The interconnection between the center leg (140) and the said leg bracket means (293) allows the center vertical leg (260) to be moved relative to the frame center leg (140) to accommodate various sized riders. The upper section of the vertical leg (280) is angled, at the vertical leg angle (284), towards the rider as a means of increasing rider leg clearance.

A swing arm assembly (400) provides lever means to assist with arm propulsion and steering and is comprised of an upstanding left swing arm (410) and right swing arm (430). Said left swing arm (410) is composed an left upper section (415), a left middle section (420) and a left lower section (425); said right swing arm (430) is composed an right upper section (435), a right middle section (440) and a right lower section (445).

An elongated rigid swing arm mount (450), generally comprised of cylindrical metal or composite tube or rod means interrelates the left swing arm (410), the center vertical leg (260) and the right swing arm (430). Vertical leg swing arm apertures (285), intermediate the vertical leg angle (284) and the vertical leg second end (287), are in alignment with left middle swing arm apertures (417) and right middle swing arm apertures (437); said apertures are sized to receive and do receive the swing arm mount (450). The swing arm mount (450) has a left end (455) and a right end (460) and is orthogonal to the frame center leg (140). The left middle swing arm section (420) is received at the swing arm mount (450) left end (455) and is rotatably affixed, by rotatable means, proximal the left end (455); the right middle swing arm section (440) is received at the swing arm mount (450) right end (440) and is rotatably affixed, by rotatable means, proximal the right end (460). Rotatable means comprising bearing and or bushing means at said left middle swing arm apertures (417) and right middle swing arm apertures (437) where said bearing and or bushing means in turn rotatably receives the said swing arm mount (450). Said left middle swing arm section (420) and right middle swing arm section (440) are positionally fixed by pin, set screw, or other equivalent position fixing means.

The swing arm assembly (400) is upstanding relative to the frame center leg (140).

Figure 2:
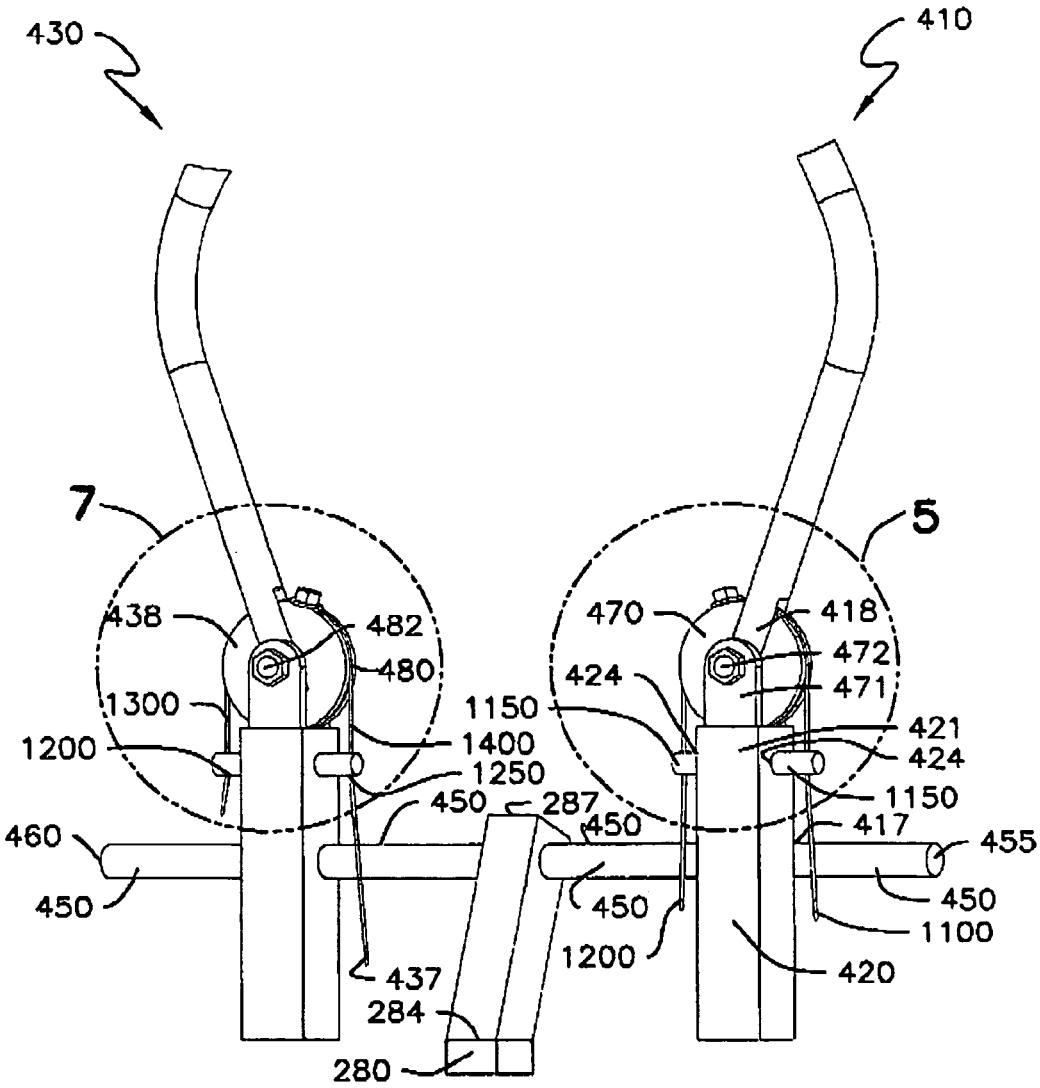
FIG. 2 is a detail of the swing arm assembly (400) as section 2 from FIG. 1.
Figure 3:
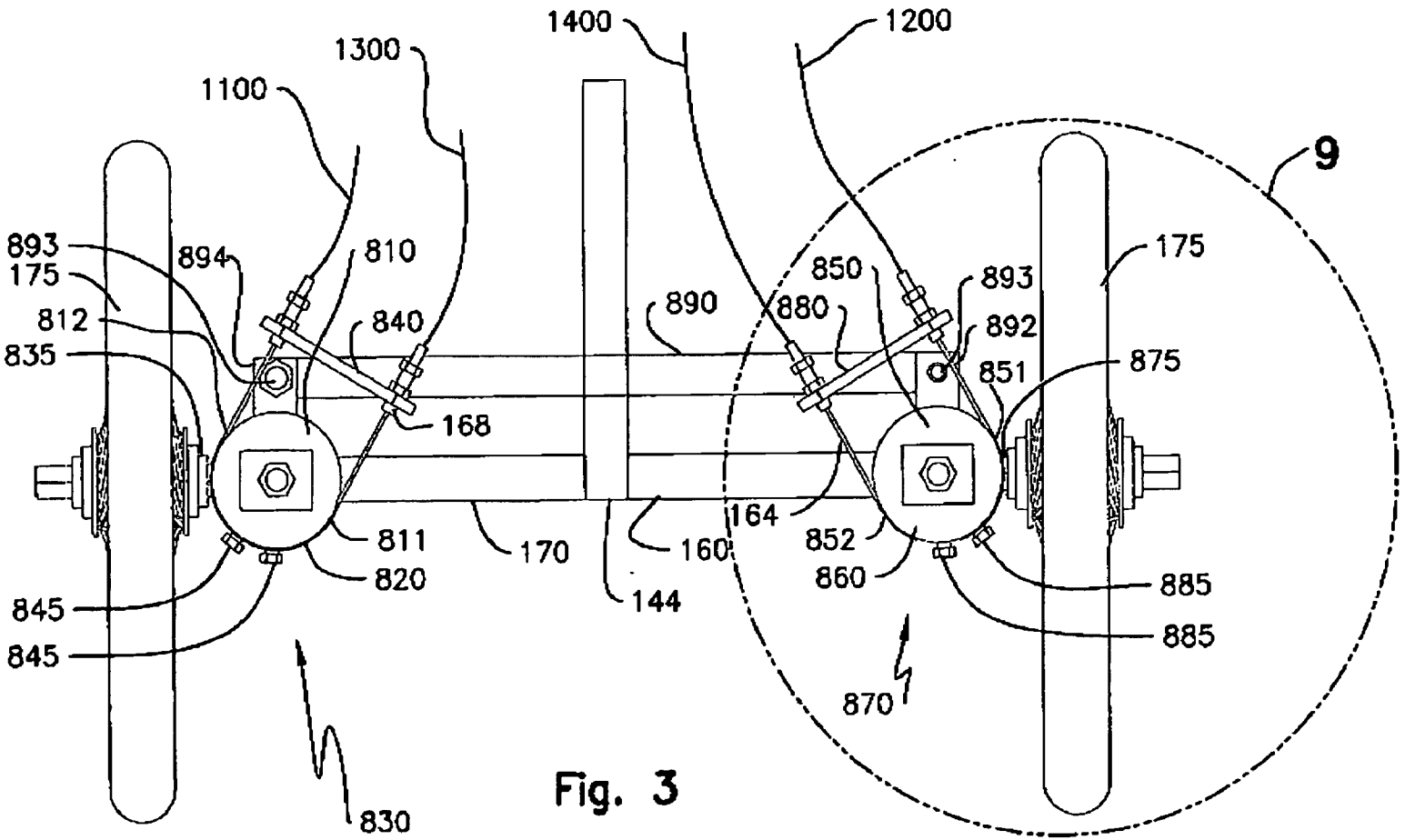
FIG. 3 is a plan detail and section 3 from FIG. 1 of the front wheels (175) and steering related features.
Figure 4:
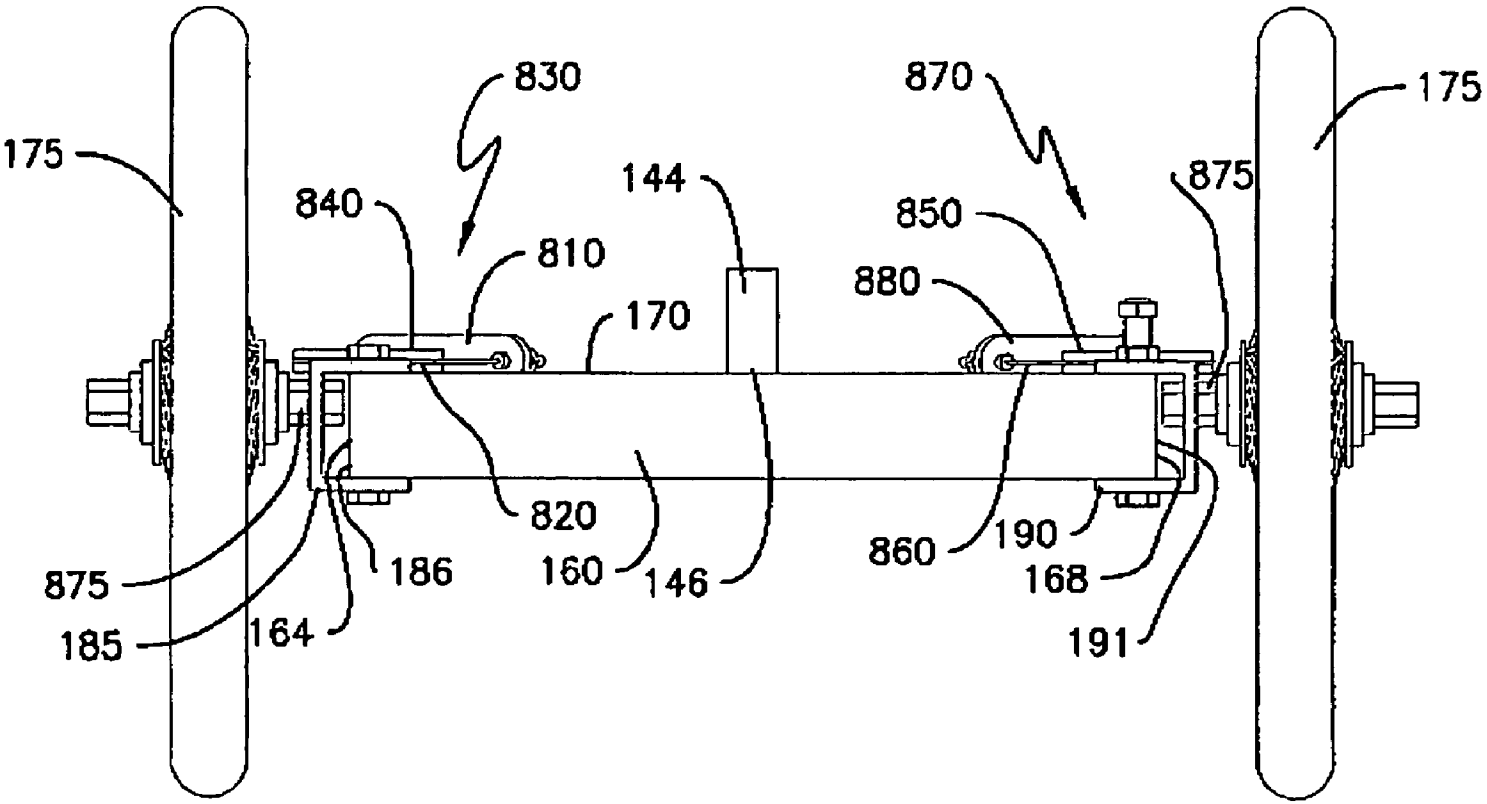
FIG. 4 is a front elevation of the front wheel (175) assembly.
Figure 5:
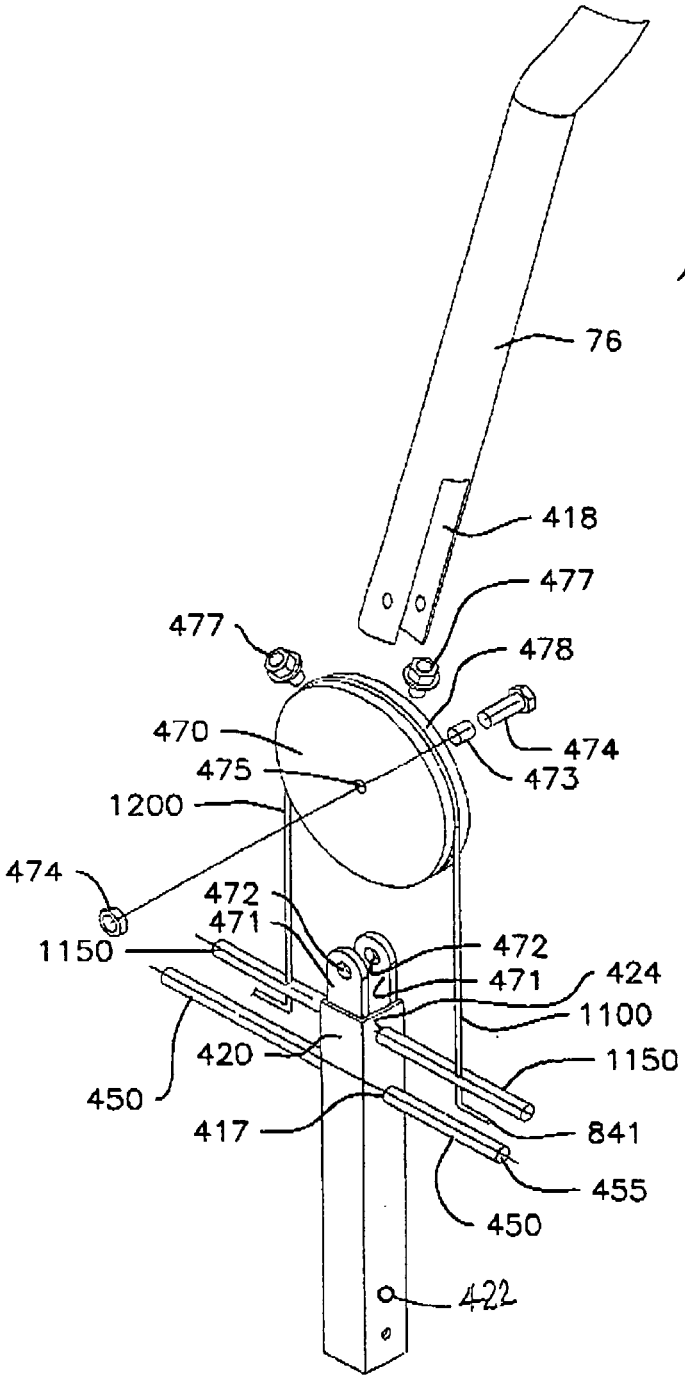
FIG. 5 is detail from FIG. 2 of the left upper swing arm section (415) and left master hub (470).
Figure 6:
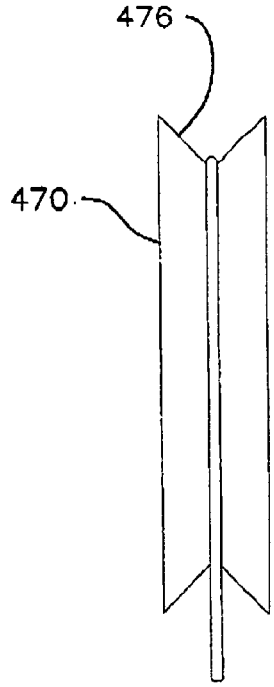
FIG. 6 is a side elevation of the left master hub (470).
Figure 7:
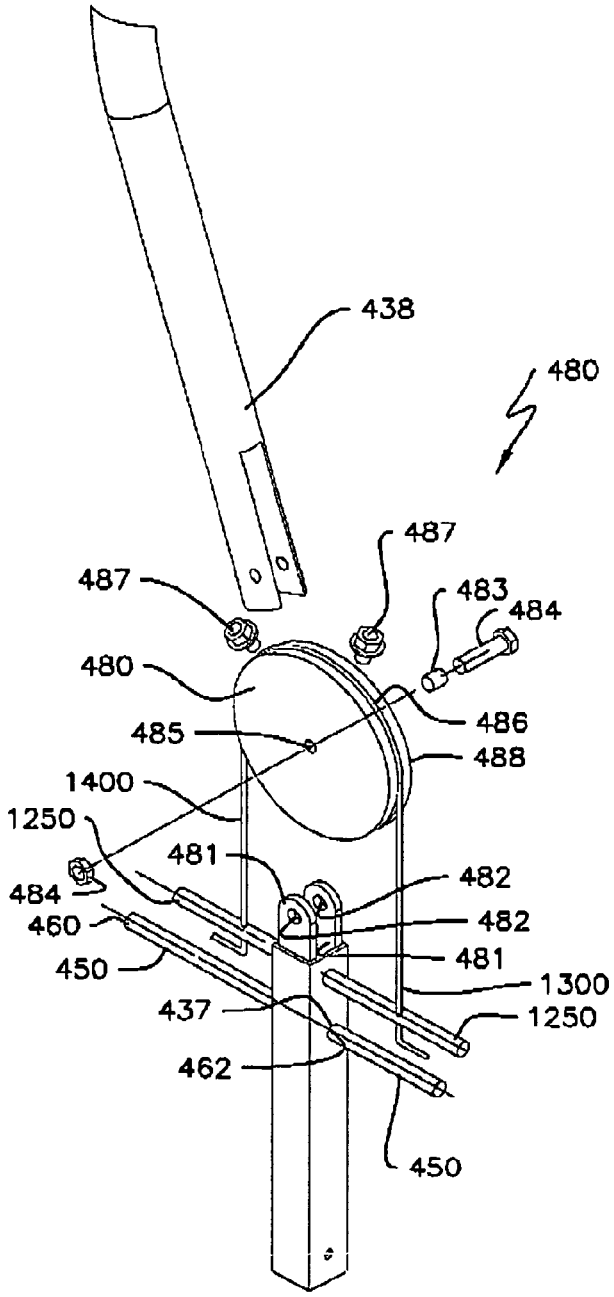
FIG. 7 is a detail from FIG. 2 of the right upper swing arm section (435) and right master hub (480).
Figure 8:
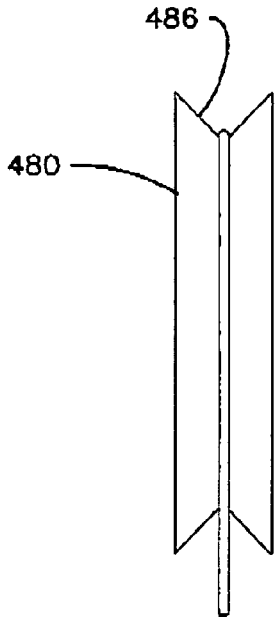
FIG. 8 is a side elevation of the right master hub (470).
Figure 9:
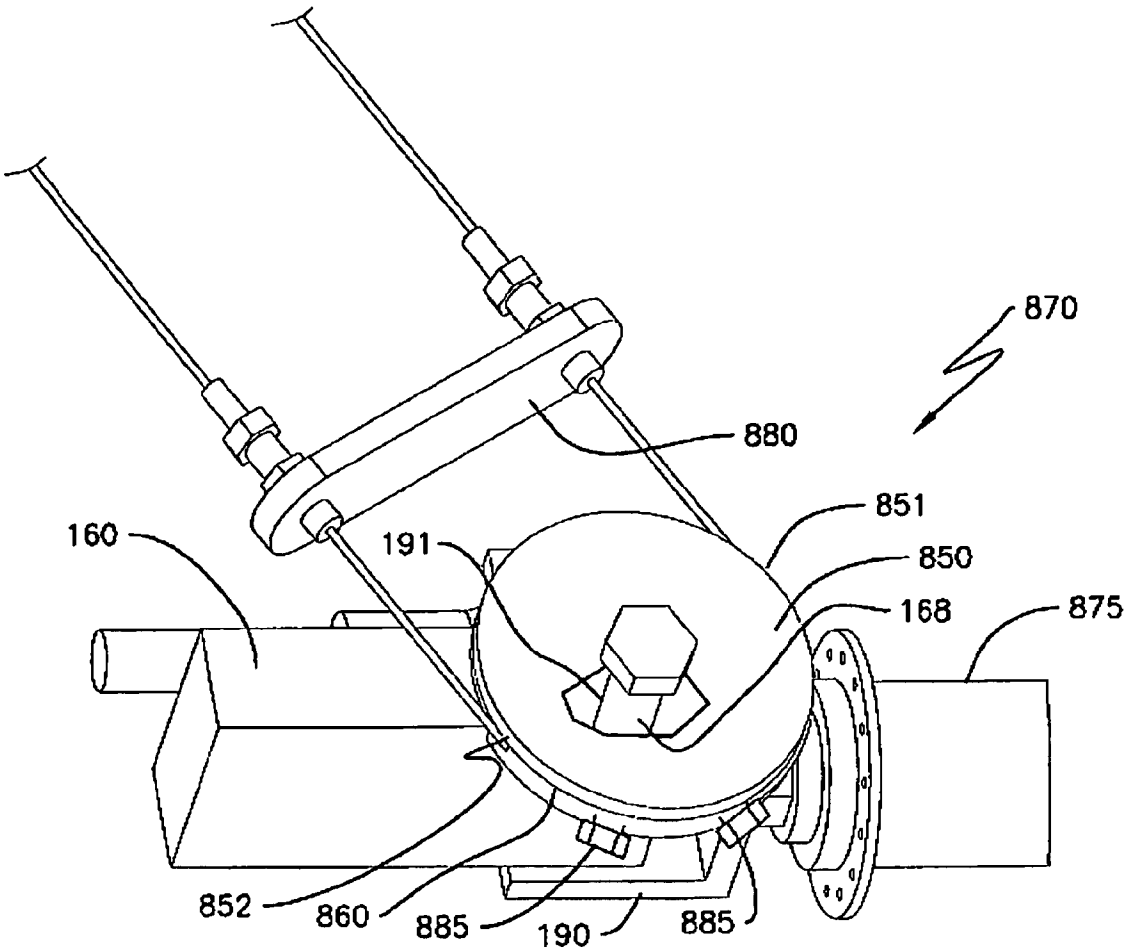
FIG. 9 is a detail from FIG. 3 showing the left steering hub (850). Those of ordinary skill will recognize that the elements of the right steering hub (810) are represented in mirror image from that shown in the left steering hub (850).

The tubular left swing arm (410) is comprised of a left middle swing arm section (420) intermediate a left lower swing arm section (425) and a left upper swing arm section (415). FIGS. 1 and 2 show the upper swing arm section (415). The left upper swing arm section (415) has a left upper swing arm upper end (416) and a left upper swing arm lower end (418). The left middle swing arm section (420) has a left middle swing arm upper end (421), a left middle swing arm lower end (423), at least one left middle swing arm adjustment aperture (422) intermediate the left middle swing arm upper end (421) and the left middle swing arm lower end (423) and at least one left middle swing arm aperture (424). The left lower swing arm section (425) has a left lower swing arm upper end (426), a left lower swing arm lower end (428), at least one left lower swing arm adjustment aperture (427) intermediate the left lower swing arm upper end (426) and the left lower swing arm lower end (428) and at least one left lower swing arm aperture (429) proximal the left lower swing arm lower end (428). The left swing arm (410) and the right swing arm (430) are composed primarily of tubular construction including but not limited to metal tubing.

The tubular left middle swing arm lower end (423) receiving or being received by the tubular left lower swing arm upper end (426) such that the at least one left middle swing arm adjustment aperture (422) and the at least one left lower swing arm adjustment aperture (427) are aligned to receive affixing means comprised generally of bolt and nut means or the equivalent. Those of ordinary skills in the interconnection of tubular arts will appreciate that there will be at least two left middle swing arm adjustment apertures (422) and at least two left lower swing arm adjustment apertures (427) which will be in alignment to receive affixing means for the purpose of adjusting the length of the entirety of the left middle swing arm section (420) and the left lower swing arm section (425) from the left middle swing arm upper end (441) to the left lower swing arm lower end (448).

The tubular right swing arm (430) is comprised of a right middle swing arm section (440) intermediate a right lower swing arm section (445) and a right upper swing arm section (435). The right upper swing arm section (435) has a right upper swing arm upper end (436) and a right upper swing arm lower end (438). The right middle swing arm section (440) has a right middle swing arm upper end (441), a right middle swing arm lower end (443), at least one right middle swing arm adjustment aperture (442) intermediate the right middle swing arm upper end (441) and the right middle swing arm lower end (443) and at least one right middle swing arm aperture (444). The right lower swing arm section (445) has a right lower swing arm upper end (446), a right lower swing arm lower end (448), at least one right lower swing arm adjustment aperture (447) intermediate the right lower swing arm upper end (446) and the right lower swing arm lower end (448) and at least one right lower swing arm aperture (449) proximal the right lower swing arm lower end (448). The right swing arm (410) and the left swing arm (430) are composed primarily of tubular construction including but not limited to metal tubing.

The tubular right middle swing arm lower end (443) receiving or being received by the tubular right lower swing arm upper end (446) such that the at least one right middle swing arm adjustment aperture (442) and the at least one right lower swing arm adjustment aperture (447) are aligned to receive affixing means comprised generally of bolt and nut means or the equivalent. Those of ordinary skills in the interconnection of tubular arts will appreciate that there will be at least two right middle swing arm adjustment apertures (442) and at least two right lower swing arm adjustment apertures (447) which will be in alignment to receive tubular affixing means for the purpose of adjusting the length of the entirety of the right middle swing arm section (440) and the right lower swing arm section (445) from the from the right middle swing arm upper end (441) to the right lower swing arm lower end (448). Tubular affixing means includes bolt with nut, rivet and other equivalent means.

A left master hub (470) immovably affixed by hub affixing means at the left upper swing arm lower end (418). Hub affixing means comprising generally welding, threaded means between the left master hub (470) and the left upper swing arm lower end (418), bolt/nut means, screw and other means as will be appreciated by those of ordinary skills in the mechanical arts. Left master hub bracket means (471) are immovably affixed by bracket affixing means at the left middle swing arm upper end (421). The left master hub (470) is received by the left master hub bracket means (471) and is pivotally affixed relative to the left master hub bracket means (471). The left master hub (470) has at least one left master hub bracket aperture (472) which aligns with at least one left master hub aperture (475). The at least one left master hub bracket aperture (472) and the at least one left master hub aperture (475) receive left master hubs bushing or bearing means (473) wherein said bushing or bearing means (473) comprises bearing surfaces, including bushings and or bearings, for the left master hub aperture (475). Said left master hub bushing or bearing means (473) receives a rotatable affixing means (474) between the said left master hub (470) and the left master hub bracket means (471) wherein, in the preferred embodiment, said rotatable affixing means includes a bolt and nut received by the left master hub bushing or bearing means (473). The left master hub (470) is generally disk shaped having a left master hub groove (476) at a left master hub perimeter (478) where the left master hub groove (476) is principally "V" or "U" shaped to receive cable means for steering control (1000) comprising a first left side steering cable (1100) and a first right side steering cable (1200). The said first left side steering cable (1100) fixedly terminated at the left master hub (470) at the left master hub groove (476) by a nonadjustable cable fixing means (477) which anchors the indicated cable by screw, bolt, welding or other immovable fixing means. The said first right side steering cable (1200) fixedly terminated at the left master hub (470) at the left master hub groove (476) by a nonadjustable cable fixing means (477) which nonadjustable cable fixing means or anchors comprising screw, bolt, welding or other immovable fixing means. A right master hub (480) immovably affixed by hub affixing means at the right upper swing arm lower end (438). Hub affixing means comprising generally welding, threaded means between the right master hub (480) and the right upper swing arm lower end (438), bolt/nut means, screw and other means as will be appreciated by those of ordinary skills in the mechanical arts. Right master hub bracket means (481) are immovably affixed by bracket affixing means at the right middle swing arm upper end (441). The right master hub (480) is received by the right master hub bracket means (481). The right master hub (480) has at least one right master hub bracket aperture (482) which aligns with at least one right master hub aperture (485). The at least one right master hub bracket aperture (482) and the at least one right master hub bracket aperture (482) receive right master hubs bushing or bearing means (483) wherein said bushing or bearing means (483) comprises bearing surfaces, including bushings and or bearings, for the said right master hub aperture (485). Said right master hub bushing or bearing means (483) receives a rotatable affixing means (484) between the said right master hub (480) and the right master hub bracket means (481) wherein, in the preferred embodiment, said rotatable affixing means includes a bolt and nut received by the right master hub bushing or bearing means (483). The right master hub (480) is generally disk shaped having a right master hub groove (486) at a right master hub perimeter (488) where the right master hub groove (486) is principaly "V" or "U" shaped to receive a second right side steering cable (1300) and a second left side steering cable (1400). The said second right side steering cable (1300) fixedly terminated at the right master hub (480) at the right master hub groove (486) by a nonadjustable cable fixing means (487) which anchors the indicated cable by screw, bolt, welding or other immovable fixing means. The said second left side steering cable (1400) fixedly terminated at the right master hub (480) at the right master hub groove (486) by a nonadjustable cable fixing means (487) which anchors the indicated cable by screw, bolt, welding or other immovable fixing means.

Hand grip or lever means (610) for brake assembly (600) operation positioned proximal the left upper swing arm upper end (416) or proximal the right upper swing arm upper end (436). Derailer hand grip or shift levers (750) for derailer gear operation positioned proximal the left upper swing arm upper end (416) or proximal the right upper swing arm upper end (436).

The tubular left swing arm (410) and the tubular right swing arm (430) rotate about the swing arm mount (450). The left swing arm (410) and the right swing arm (430) cycle toward the front "T" frame (160), then away from the front "T" frame (160) toward the rear "T" frame (180) and back for the complete cycle. The cycle of the left swing arm (410) and the cycle of the right swing arm (430) each ascribes a vertical upstanding plane parallel to the frame center leg (140) and the center vertical leg (260). The left upper swing arm section (415) and the right upper swing arm section (435) rotate respectively relative to the left middle swing arm section (420) and the right middle swing arm section (440), about the respective left master hub aperture (475) and the right master hub aperture (485), ascribing a rotation plane orthogonal to the swing plane ascribed by the left swing arm (410) and the right swing arm (430). When turning forces are exerted at the left upper swing arm section (415) and the right upper swing arm section (435), it is noted that the said left upper swing arm section (415) and the right upper swing arm section (435) are never pivoting forward or backward, relative to the frame center leg (140) but remain, relative to the frame center leg (140), in a plane parallel to that of the frame center leg (140) and the center vertical leg (260).

FIGS. 1, 2, 3, 4 and 9 show the left upper swing arm section (415), right upper swing arm section (435), left master hub (470), right master hub (480), right steering hub (810) and left steering hub (850). The left upper swing arm section (415) and the right upper swing arm section (435), when rotated, exert forces on the left side steering cable (1100) and the right side steering cable (1200) which are in steering communication with a steering unit (800). The steering unit (800), proximal to or at the center leg first end (144), comprises a right axle (835) affixed by axle affixing means at the front "T" frame first end (164) at a right steering knuckle (830) and a left axle (875) affixed by axle affixing means at the front "T" frame second end (168) at a left steering knuckle (870). At least one front wheel (175) rotatably affixed by wheel affixing means at each of the said right axle (835) and left axle (875) respectfully distal to the front "T" frame first end (164) and the front "T" frame second end (168). The right steering knuckle (830) comprises a right steering hub (810) immovably affixed by fixing means to a right bearing mount (185); a bushing or bearing means and housing with shaft (186) received by the rotatable right bearing mount (185); the right axle (835) extending from and affixed by axle affixing means to the right bearing mount (185). The left steering knuckle (870) comprises a left steering hub (850) immovably affixed by fixing means to a left bearing mount (190); a bushing or bearing means and housing with shaft (168) received by the rotatable left bearing mount (190); the left axle (875) extending from and affixed by axle affixing means to the left bearing mount (190). A tie bar (890) interrelates the right steering hub (810) and the left steering hub (850) to insure alignment and coordinated parallel movement between the at least one front wheel (175) at each of the said right axle (835) and left axle (875). A left tie bar connection (892) and a right tie bar connection (894) affixed by immovable means respectively at the left bearing mount (190) and the right bearing mount (185) receive the tie bar (890) by rotatable connection means (893).

The steering communication means between the left upper swing arm section (415) and left master hub (470) is respectively by the first left side steering cable (1100) and second right side steering cable (1200) connection with the left steering hub (850) and the right steering hub (810) respectively; and between the right upper swing arm section (435) and right master hub (480) is respectively by second left side steering cable (1300) and second right side steering cable (1400) connection with the right steering hub (810) and the left steering hub (850) respectively. Thus the left upper swing arm section (415), when pivoted at the left master hub (470) exerts rotational forces at both the right steering hub (810) and the left steering hub (850) and the right upper swing arm section (435), when pivoted at the right master hub (480) exerts rotational forces at both the right steering hub (810) and the left steering hub (850).

In the preferred embodiment the right steering hub (810) is primarily disk shaped having a right steering hub grove (820) receiving second left side steering cable (1300) and second right side steering cable (1400) and the left steering hub (850), primarily disk shaped and having a left steering hub grove (860) receives the first left side steering cable (1100) and the first right side steering cable (1200).

The steering cable interconnections are as follows:

1.) From the left master hub (470) thread the first left side steering cable (1100) through cable shield means to a right hub right side (812) position of the right steering hub (810) at the right steering hub grove (820) to be secured by right steering hub cable securing means (845);

2.) from the left master hub (470) thread the first right side steering cable (1200) through cable shield means to a left hub left side (851) position of the left steering hub (850) at the left steering hub grove (860) to be secured by right steering hub cable securing means (885);

3.) from the right master hub (480) thread the second left side steering cable (1400) through cable shield means to a left hub right side (852) position of the left steering hub (850) at the left steering hub grove (860) to be secured by left steering hub cable securing means (885);

4.) from the right master hub (480) thread the second right side steering cable (1300) through cable shield means to a right hub left side (811) position of the right steering hub (810) at the right steering hub grove (820) to be secured by right steering hub cable securing means (845).

Cable guide means provided, in the preferred embodiment, by left side steering cable guide (1150) and right side steering cable guide (1250) received respectively by left middle swing arm aperture (424) and right middle swing arm aperture (444). Left side steering cable guide (1150) and right side steering cable guide (1250) have guide means to receive cable where such means includes aperture means. Right steering hub cable guide (840) and left steering hub cable guide (880) immovably affixed by means respectively at the right steering hub (810) and left steering hub (850); said right steering hub cable guide (840) and left steering hub cable guide (880) have guide means to receive cable where such means includes aperture means. First left side cable (1100), first right side cable (1200), second left side cable (1300) and second left side cable (1400) are received and guided by said cable guide means; said cables, in the preferred embodiment, are comprised of aircraft quality cable. The left master hub groove (476), right master hub groove (486), the right steering hub groove (820) and the left steering hub groove (860) are grooved to captivate said cable including air craft quality cable for steering control. It is noted that there is no rotational cable movement at the left master hub groove (476), right master hub groove (486), the right steering hub groove (820) and the left steering hub groove (860) with cable movement only through cable shield means. Cable shield means (841) is provided by plastic, metal and other tubing means. Adjustable cable shield dead heads mounted on the main frame to take slack out of steering and adjust position of the handle bars for rider comfort as desired.

The left master hub (470) and the right master hub (480), primarily disk shaped and circular have a diameter either equal to or less than the diameter of the primarily disk shaped and circular right steering hub (810) and left steering hub (850).

The front "T" frame (160) is mounted under the frame center leg (140) to maintain horizontal ground clearance and keep the right steering knuckle (830) and left steering knuckle (870) vertical to the riding surface.

The left axle (875), when axle affixing means is a threaded means, will have a left hand thread to prevent the rotation of the wheel from loosening the nut means used to captivate bearings and seals.

There are adjustable cable shield means (495) mounted on the main frame (100) primarily at the frame center leg (140) or the center vertical leg (260) allowing cable adjustment to add or remove slack from steering, brake or derailer cables as adjustments are made for operator size and preferences.

The left upper swing arm section (415) and right upper swing arm section (435) provide a handle bars function; said left upper swing arm section (415) and right upper swing arm section (435) are rotatably adjustable in position as desired by the operator.

The front wheel base (179), in the preferred embodiment, is wider from center to center than the back wheel base (199) providing greater stability in operation. The front wheels (175), in the preferred embodiment, are smaller in diameter than the rear wheels (195) with larger rear wheels preferred for operational clearance between riding surface and driving components. In the preferred embodiment, front wheels (175) will have 16" tires and rear wheels will have 20" tires to provide ground clearance and to allow derailer operation.

Foot pads (500) comprise an elongated substantially planar left foot pad (510) and right foot pad (540); the left foot pad (510) having a left foot pad first end (545), a left foot pad second end (550) and a left foot pad center (555); the right foot pad (540) having a right foot pad first end (545), a right foot pad second end (520) and a right foot pad center (555). Bushing and shaft receiving means at the left lower swing arm lower end (428) and at the right lower swing arm lower end (448) align with and rotatably receive bushing and shaft receiving means at the left foot pad first end (515) and right foot pad first end (545) respectively for a rotatable interaction. Bushing and shaft receiving means includes aperture means at said left foot pad first end (515) and right foot pad first end (545) and at the said left lower swing arm lower end (428) and at the right lower swing arm lower end (448) including the left lower swing arm aperture (429) and the right lower swing arm aperture (449). Bushing and shaft receiving means at the left foot pad second end (520) and at the right foot pad second end (550) align with and rotatably receive bicycle drive cam means at the right and left respectively where the drive cam means, in the preferred embodiment, is a standard bicycle drive cam (730). Arm lever action and foot action at the left swing arm (410) and right swing arm (430) and at the left foot pad (510) and right foot pad (540) exert forces against the drive cam (730) and derailer gear assembly (705) to propel the quad cycle (1).

Figure 10:
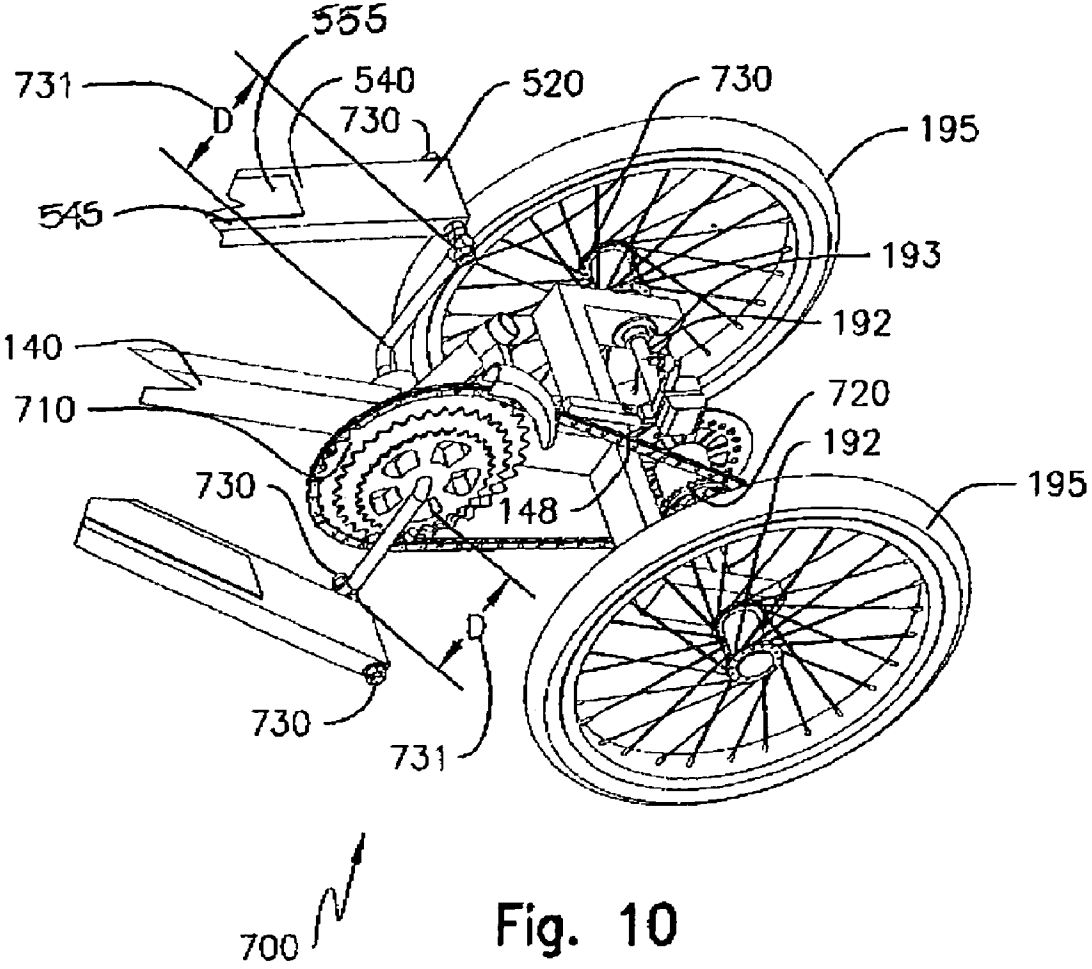
FIG. 10 is a perspective showing an alternative embodiment of the quad cycle (1) rear axle (192) bearing means (193) and wheels (195)

FIG. 10 is a perspective showing an alternative embodiment of the quad cycle (1) rear axle (192) bearing means (193) and wheels (195)

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

We claim:

1. A quad cycle comprising the following:

a. a frame means, the frame means receiving bearing means which receives a rear axle (192); the rear axle (192) rotatably receiving a plurality of rear wheels (195);

b. the frame means fixedly receiving a steering unit (800) distal to the rear axle (192); a right axle (835) and a left axle (875) rotatably affixed by steerable means to the steering unit (800); the right axle (835) and the left axle (875) rotatably receiving at least one front wheel (175) respectively;

c. a bicycle derailer (700) assembly is mounted by derailer mounting means (711) at the frame means and proximal to the rear axle (192); the derailer (700) assembly having a drive cam (730); a brake assembly (600) mounted by brake mounting means at the frame means to exert braking forces at a brake rotor (640) at the rear axle (192);

d. the frame means rotatably receiving an upright swing arm assembly (400); said swing arm assembly in lever and rotation communication with the drive cam (730); the upright swing arm assembly (400) in steering cable communication with the steering unit (800), the right axle (835) and the left axle (875);

e. the frame means comprising a main frame (100) having at least one elongated center leg (140) having a center leg first end (144) and a center leg second end (148); a front "T" frame (160), generally tubular and elongated, is affixed by frame affixing means at the center leg first end (144); the front "T" frame (160) is comprised of a frame member generally orthogonal to the at least one center leg (140); a rear "T" frame (180), generally elongated and affixed by frame affixing means at the center leg second end (148); the rear "T" frame (180) is composed of a frame member generally orthogonal to the at least one center leg first end (144);

f. steering and propulsion means provided in association with a center vertical frame means (260) or seen as the center vertical leg (260), swing arms (400) and foot pads (500); frame means is generally formed from tubular materials including a variety of cross sections of metal or composite materials; the center vertical leg (260) is upstanding and has an upper vertical leg section (280) and a lower vertical leg section (290) having a lower leg first end (291); vertical leg bracket means (293) affixed by immovable means at the lower leg first end (291) and oriented to receive the frame center leg (140) intermediate the center leg first end (144) and the derailer mounting means (711); the center vertical leg (260) is moveably or immovably affixed at the frame center leg (140);

g. the upright swing arm assembly (400) comprised of a left swing arm (410) and a right swing arm (430); an elongated rigid swing arm mount (450), generally comprised of cylindrical metal or composite tube or rod means interrelates the left swing (410), the center vertical leg (260) and the right swing arm (430); vertical leg swing arm apertures (285) proximal and the vertical leg second end (287), are in alignment with left middle swing arm apertures (417) and right middle swing arm apertures (437); said apertures are sized to receive and do receive the swing arm mount (450); the swing arm mount (450) has a left end (455) and a right end (460) and is orthogonal to the frame center leg (140); the left middle swing arm section (420) is received at the swing arm mount (450) left end (455) and is rotatably affixed, by rotatable means, proximal the left end (455); the right middle swing arm section (440) is received at the swing arm mount (450) right end (460) and is rotatably affixed, by rotatable means, proximal the right end (460); the left swing arm (410) has a left lower swing arm lower end (428); the right swing arm (430) has a right lower swing arm lower end (448);

h. foot pads (500) comprise an elongated substantially planar left foot pad (510) and right foot pad (540); the left foot pad (510) having a left foot pad first end (545), a left foot pad second end (550) and a left foot pad center (555); the right foot pad (540) having a right foot pad first end (545), a right foot pad second end (520) and a right foot pad center (555); bushing and shaft receiving means at the left lower swing arm lower end 428 and at the rigjt lower swing arm lower end (448) align with and rotatably receive a corresponding bushing and shaft at the left foot pad first end (515) and right foot pad first end (545) respectively for a rotatable interaction; arm lever action and foot action at the left swing arm (410) and right swing arm (430) and at the left foot pad (510) and right foot pad (540) exert forces against the drive cam (730) and derailer gear assembly (705) to propel the quad cycle (1);

I. the tubular left swing arm (410) is comprised of a left middle swing arm section (420) intermediate a left lower swing arm section (425) and a left upper swing arm section (415) having a left upper swing arm lower end (418); the tubular right swing arm (430) is comprised of a right middle swing arm section (440) intermediate a right lower swing arm section (445) and a right upper swing arm section (435) having a right upper swing arm lower end (438);

j. a left master hub (470) immovably affixed by hub affixing means at the left upper swing arm lower end (418); the left middle swing arm section (420) has a left middle swing arm upper end (421); a left master hub bracket means (471) is immovably affixed by bracket affixing means at the left middle swing arm upper end (421); the left master hub (470) is received by the left master hub bracket means (471) and is pivotally affixed relative to the left master hub bracket means (471);

k. a right master hub (480) immovably affixed by hub affixing means at the right upper swing arm lower end (438); the right middle swing arm section (440) has a right middle swing arm upper end (441); a right master hub bracket means (481) is immovably affixed by bracket affixing means at the right middle swing arm upper end (441); the right master hub (480) is received by the right master hub bracket means (481) and is pivotally affixed relative to the right master hub bracket means (481);

l. the left master hub (470) is generally disk shaped having a left master hub groove (476) at a left master hub perimeter (478) where the left master hub groove (476) is principally "V" or "U" shaped to receive cable means for steering control (1000) comprising a first left side steering cable (1100) and a first right side steering cable (1200); the said first left side steering cable (1100) fixedly terminated at the left master hub (470) at the left master hub groove (476) by a nonadjustable cable fixing means (477) which anchors the indicated cable by screw, bolt, welding or other immovable fixing means; the said first right side steering cable (1200) fixedly terminated at the left master hub (470) at the left master hub groove (476) by a nonadjustable cable fixing means (477) which nonadjustable cable fixing means or anchors comprising screw, bolt, welding or other immovable fixing means;

m. the right master hub (480) is generally disk shaped having a right master hub groove (486) at a right master hub perimeter (488) where the right master hub groove (486) is principally "V" or "U" shaped to receive a second right side steering cable (1300) and a second left side steering cable (1400); the said second right side steering cable (1300) fixedly terminated at the right master hub (480) at the right master hub groove (486) by a nonadjustable cable fixing means (487) which anchors the indicated cable by screw, bolt, welding or other immovable fixing means; the said second left side steering cable (1400) fixedly terminated at the right master hub (480) at the right master hub groove (486) by a nonadjustable cable fixing means (487) which anchors the indicated cable by screw, bolt, welding or other immovable fixing means;

n. the tubular left swing arm (410) and the tubular right swing arm (430) rotate about the swing arm mount (450); the left swing arm (410) and the right swing arm (430) cycle toward the front "T" frame (160), then away from the front "T" frame (160) toward the rear "T" frame (180) and back for the complete cycle; the cycle of the left swing arm (410) and the cycle of the right swing arm (430) each ascribes a vertical upstanding planes parallel to the frame center leg (140) and the center vertical leg (260);

o. the left upper swing arm section (415) and the right upper swing arm section (435) rotate respectively relative to the left middle swing arm section (420) and the right middle swing arm section (440), about the respective left master hub aperture (475) and the right master hub aperture (485), ascribing a rotation plane orthogonal to the swing plane ascribed by the left swing arm (410) and the right swing arm (430); when turning forces are exerted at left upper swing arm section (415) and the right upper swing arm section (435), it is noted that the said left upper swing arm section (415) and the right upper swing arm section (435) are never pivoting forward or backward, relative to the frame center leg (140) but remain, relative to the frame center leg (140), in a plane parallel to that of the frame center leg (140) and the center vertical leg 260);

p. the left upper swing arm section (415) and the right upper swing arm section (435), when rotated, exert forces on the steering cable (1100) and the right side steering cable (1200) which are in steering communication with a steering unit (800); the steering unit (800), proximal to or at the center leg first end (144), comprises a right axle (835) affixed by axle affixing means at the front "T" frame first end (164) at a right steering knuckle (830) and a left axle (875) affixed by axle affixing means at the front "T" frame second end (168)

at a left steering knuckle (870); at least one front wheel (175) rotatably affixed by wheel affixing means at each of the said right axle (835) and left axle (875) respectfully distal to the front "T" frame first end (164) and the front "T" frame second end (168);

q. the right steering knuckle (830) comprises a right steering hub (810) immovably affixed by fixing means to a right bearing mount (185); bushing or bearing means and housing with shaft (186) received by the rotatable right bearing mount (185); the right axle (835) extending from and affixed by axle affixing means to the right bearing mount (185);

r. the left steering knuckle (870) comprises a left steering hub (850) immovably affixed by fixing means to a left bearing mount (191); a bushing or bearing means and housing with shaft (168) received by the rotatable left bearing mount (191); the left axle (875) extending from and affixed by axle affixing means to the left bearing mount (190);

s. a tie bar (890) interrelates the right steering the right hub (810) and the left steering hub (850) to insure alignment and coordinated parallel movement between the at least one front wheel (175) at each of the said right axle (835) and left axle (875); a left tie bar connection (892) and right tie bar connection (894) affixed by immovable means respectively at the left bearing mount (190) and the right bearing mount (185) receive the tie bar (890) by rotatable connection means (893);

t. the steering communication means between the left upper swing arm section (415) and left master hub (470) is respectively by the first left side steering cable (1100) and second right side steering cable (1200) connection with the left steering hub (850) and the right steering hub (810) respectively; and between the right upper swing arm section (435) and right master hub (480) is respectively by second left side steering cable (1300) and second right side steering cable (1400) connection with the right steering hub (810) and the left steering hub (850) respectively;

u. the left upper swing arm section (415), when pivoted at the left master hub (470) exerts rotational forces at both the right steering hub (810) and the left steering hub (850) and the right upper swing arm section (435), when pivoted at the right steering (480) exerts rotational forces at both the right steering hub (810) and the left steering hub (850).

* * * * *